US005265746A

United States Patent [19]

Lee

[11] Patent Number: 5,265,746

[45] Date of Patent: Nov. 30, 1993

[54] BOTTLE CAP HAVING INTEGRAL OPENER

[76] Inventor: Jeong M. Lee, 172-31, Myun Mok 5 Dong, Jung Rang-Ku Seoul, Rep. of Korea

[21] Appl. No.: 906,815

[22] Filed: Jun. 30, 1992

[30] Foreign Application Priority Data

Jul. 5, 1991 [KR] Rep. of Korea ..... 10231/1991
Dec. 5, 1991 [KR] Rep. of Korea ..... 21346/1991

[51] Int. Cl.[5] ..... B65D 51/24; B65D 41/12

[52] U.S. Cl. ..... 215/295; 215/303; 215/304; 215/328

[58] Field of Search ..... 215/295, 303, 304, 305, 215/328; 220/376

[56] References Cited

U.S. PATENT DOCUMENTS

| | | | |
|---|---|---|---|
| 829,341 | 8/1906 | Kirkegaard | 215/305 |
| 921,055 | 5/1909 | Aliber | 215/303 |
| 1,239,238 | 9/1917 | White | 215/305 |
| 1,978,272 | 10/1934 | Lawrence | 215/305 |
| 2,151,129 | 3/1939 | Markle | 215/305 |
| 2,337,241 | 12/1943 | Harvey et al. | 215/305 |
| 2,433,629 | 12/1947 | Shannon | 215/305 |
| 2,750,062 | 6/1956 | Satz | 215/305 |
| 2,778,520 | 1/1957 | Hyde, Jr. | 215/305 X |
| 2,848,131 | 8/1958 | Ward | 215/305 |
| 3,785,519 | 1/1974 | Huh | 215/305 X |

FOREIGN PATENT DOCUMENTS 58923 3/1991 Rep. of Korea .

*Primary Examiner*—Allan N. Shoap
*Assistant Examiner*—Vanessa Caretto
*Attorney, Agent, or Firm*—Heslin & Rothenberg

[57] ABSTRACT

A bottle cap having an integral opener on a side thereof, which is capable of opening a bottle cap made of high strength metal sheet, is disclosed. The opener includes: two reinforcing portions, a head portion, two arms, a body and two branches. The head portion is rectangularly but gently bent or its edge is curled up inwardly in order to eliminate a sharp edge therefrom. The two arms connect the upper end of the body of the opener to the side of the bottle cap, and the body is reinforced with two reinforcing portions which are added to the left and right of a longitudinal center ridge. The two branches are divided from the lower end of the body of the opener, and are outwardly bent away from the bottle. Instead of the two branches, a ring may be attached to the lower end of the body, and, in this way, the user is not hurt, and the bottle cap can be opened with a reinforced strength.

8 Claims, 3 Drawing Sheets

BOTTLE CAP HAVING INTEGRAL OPENER

FILED OF THE INVENTION

The present invention relates to a bottle cap having an integral opener, in which a high strength metallic bottle cap can be easily opened without using a separate opener.

BACKGROUND OF THE INVENTION

Generally, top sealing covers used for such small bottles as medicine bottles are made of a thin aluminum sheet, and therefore, they can be opened readily with bare hands at any place without an opener.

However, bottle caps which are used to seal bottles with a certain level of pressure formed therein, as in beer bottles and carbonate beverage bottles, are made of a thick high strength metal in order to firmly seal off the bottles with a certain level of pressure formed therein. Therefore, unlike the thin aluminum bottle caps, the high strength metallic sealing covers cannot be opened without using a separate cap opener, when the contents of the bottles are to be drunk.

However, people have to detach bottle caps to drink beer and beverages not only indoors but also in other places such as roads and open fields. When they drink indoors, there are available bottle cap openers in most cases, and therefore, there is encountered no special inconvenience. However, when bottles are opened outdoors, people have to experience much difficulty.

Further, even in the case where a cap opener is available, if the cap opener is small, people have a hard time finding the cap openers within the rooms.

There is a prior art of the bottle cap having an integral cap opener, and this prior art is disclosed in Korean Utility Model Registration No. 58923 which is granted to the present applicant. In this prior art, an elongate opener extends downwardly from a side of the bottle cap, and a space is formed on the portion where the cap opener meets the bottle cap, while the body of the cap opener is provided with an elongate bending line so as for the strength of the opener to be reinforced.

In this prior art, if the body of the opener is lifted up and then turned in the opposite direction, then the upper portion of the body of the opener is folded around the above mentioned space, thereby opening the bottle cap in an easy manner. However, when the body of the opener is folded, the portion between the bottle cap and the upper end of the body of the opener forms a sharp projection, and therefore, the user is apt to be hurt, if special care is not exercised. Further, even with the reinforcing bending line of the body of the opener, the body can be bent during use, while the adherence of the opener to the bottle makes it difficult to lift up the opener. Further, the opener is provided with only the function of opening the cap, and therefore, there is missing the aesthetic considerations for the opener.

SUMMARY OF THE INVENTION

The present invention is intended to overcome the above described disadvantages of the conventional techniques.

Therefore it is a first object of the present invention to provide a bottle cap having an integral opener, in which the projected head portion, i.e., contact portion between the bottle cap and the opener has a round form, so that the user should not be hurt during use, and that the strength of the head portion should be reinforced, thereby keeping it from being collapsed during use.

It is a second object of the present invention to provide a bottle cap having an integral opener, in which elongate reinforcing portions are provided at the left and right of a reinforcing longitudinal center ridge, so that the body of the opener should be prevented from being bent during use.

It is a third object of the present invention to provide a bottle cap having an integral opener, in which the lower end of the body of the opener is divided into two branches, and both of the branches are bent outwardly, thereby making it easy to lift up the body of the opener.

It is a fourth object of the present invention to provide a bottle cap having an integral opener, in which the body of the opener has the shape of a mascot, thereby improving the aesthetic feature of the opener.

BRIEF DESCRIPTION OF THE DRAWINGS

The above objects and other advantages of the present invention will become more apparent by describing in detail the preferred embodiment of the present invention with reference to the attached drawings in which.

DESCRIPTION OF THE PREFERRED EMBODIMENT

Figure 1:
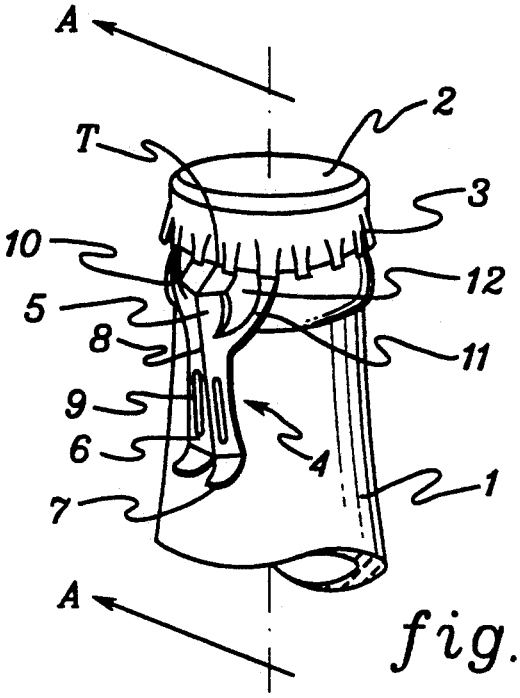
FIG. 1 is a perspective view illustrating a first embodiment of the device of the present invention.

FIG. 1 illustrates a first embodiment of the present invention, and, as shown in this drawing, an opener 4 having a body 6 integrally extends from a side of a bottle cap 2. The body 6 is formed in the shape of a saddle roof having a longitudinal center ridge 8 with elongate reinforcing roof portions 9 at either side of the ridge 8.

The upper end of the body 6 is provided with a head portion 5 and two arms 10 and 11, which are all connected to the side of the bottle cap 2. The two arms 10 and 11 are widely spread like a man spreading his arms, and the head portion 5 is rectangularly bent before being connected to the bottle cap 2, the bent edge of the head portion 5 not being sharp but being bent in a round form.

Figure 2:
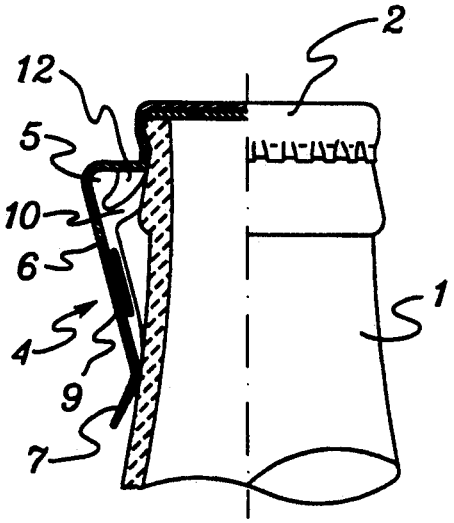
FIG. 2 is a sectional view taken along the line A—A of FIG. 1.

Further, there are formed spaces 12 between the head portion 5 and the arms 10 and 11, and the lower end of the body 6 is divided into two branches 7 from the ridge 8, in such a manner that the two branches 7 are bent in an inclined form outwardly from a bottle 1 as shown in FIG. 2.

Figure 3:
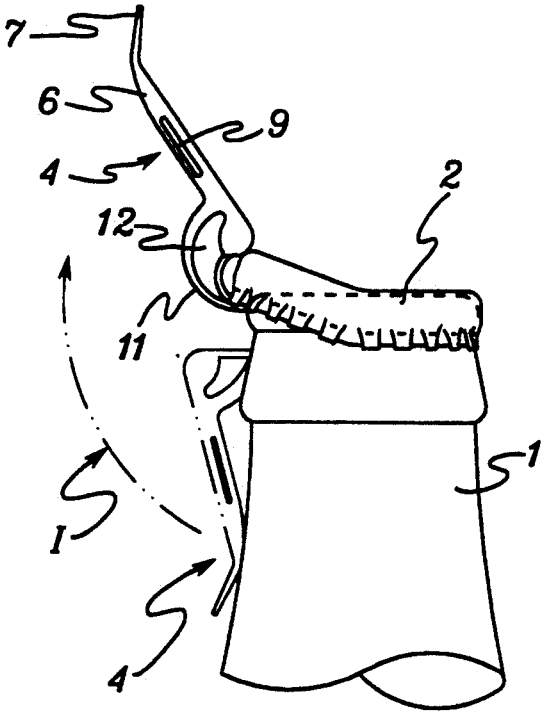
FIG. 3 illustrates a state of the use of the first embodiment of the device according to the present invention.

In the first embodiment of the device of the present invention constituted as described above, if the bottle cap 2 is to be opened from the bottle 1, the portion of the body 6 of the opener 4 is lifted up in the direction of an arrow mark I as shown in FIG. 3. Then the contact portion T between the head 5 and the bottle cap 2 as well as the arms 10 and 11 are bent as shown in FIG. 3 until the head 5 contacts with the upper edge of the side of the bottle cap 2.

In this state, if the body 6 of the opener is pulled up further in the direction of the arrow mark I, the bottle cap 2 is detached from the bottle 1 like when using a conventional opener.

In this embodiment, the body 6 is not bent during the opening of the cap 2, because the reinforcing portions 9 are formed in the lengthwise direction on the body 6. Further, the two branches 7 of the lower end of the body 6 are bent outwardly from the bottle 1 in a divided state, and therefore, it is easy to lift up the body 6, while the user will not be hurt because the bent edge of the head 5 is provided in a round form.

Figure 4:
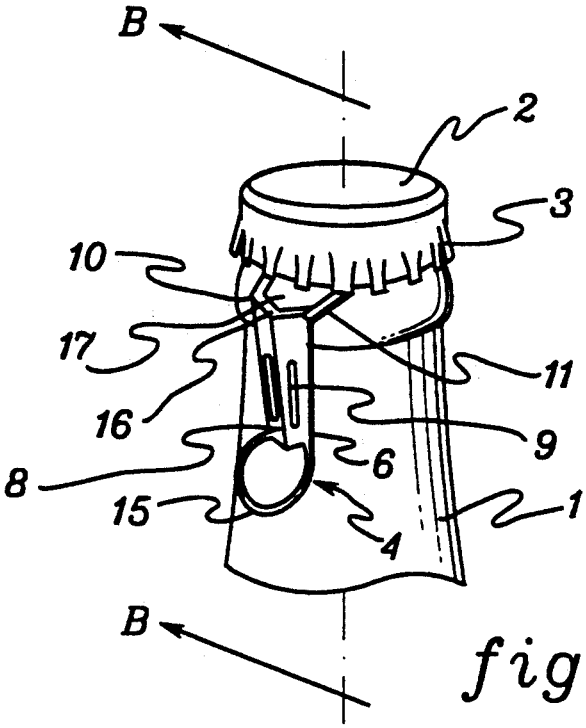
FIG. 4 is a perspective view illustrating a second embodiment of the device of the present invention.

FIG. 4 illustrates a second embodiment of the present invention.

Figure 5:
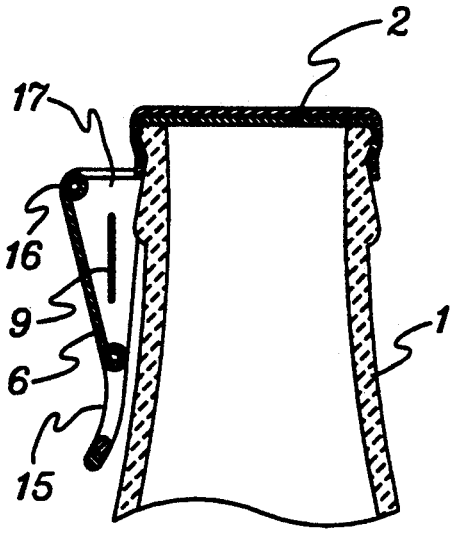
FIG. 5 is a sectional view taken along the line B—B of FIG. 4.

As shown in FIG. 4, this embodiment is constituted as described below. That is, the body 6 of the opener 4 is provided with a longitudinal center ridge 8, and elongate reinforcing portions 9 are formed at the left and right of the ridge 8, in the same form as that of the first embodiment of the present invention. The upper end of the body 6 is provided with two arms 10 and 11, and these two arms 10 and 11 are connected to the side of the bottle cap 2, while a space 17 is formed between the two arms 10 and 11. Further, the head portion 16 is deformed to be inwardly curled up so that it forms a round edge as shown in FIG. 5. Meanwhile, the lower end of the body 6 is provided with a pulling ring 15.

Figure 6:
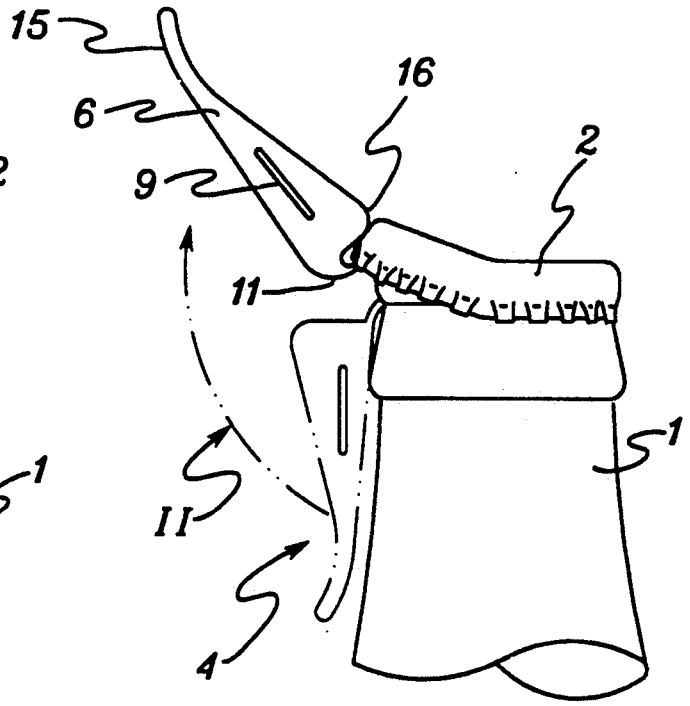
FIG. 6 is a sectional view showing a state of the use of device according to the second embodiment of the present invention.

In the second embodiment of the present invention constituted as described above, the opening of the bottle cap 2 can be carried out in the same manner as that of the first embodiment of the present invention. That is, if the pulling ring 15 is pulled up with a finger in the direction of an arrow mark II, the head 16 is contacted with the upper edge of the side of the bottle cap 2, and, if the pulling ring 15 is further pulled up, the bottle cap 2 is detached from the bottle as shown in FIG. 6.

In this embodiment, the pulling of the body 6 becomes very convenient because of the provision of the pulling ring 15, and the body 6 can be easily bent out because only two arms 10 and 11 connect the body 6 to the cap 2. Further, the edge of the head 16 is curled up inwardly, so that a user or any one else should not be hurt by a sharp edge.

Figure 7:
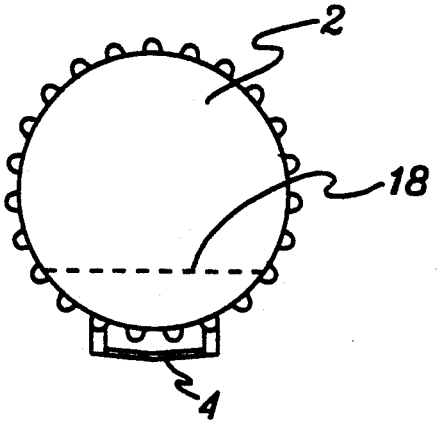
FIG. 7 is a plan view illustrating a third embodiment of the device of the present invention.

FIG. 7 illustrates a third embodiment of the present invention, and, in this embodiment, a folding line 18 is formed on the upper face of the cap 2, so that the cap 2 should be more easily opened along the folding line 18, thereby adding a further convenience.

Figure 8:
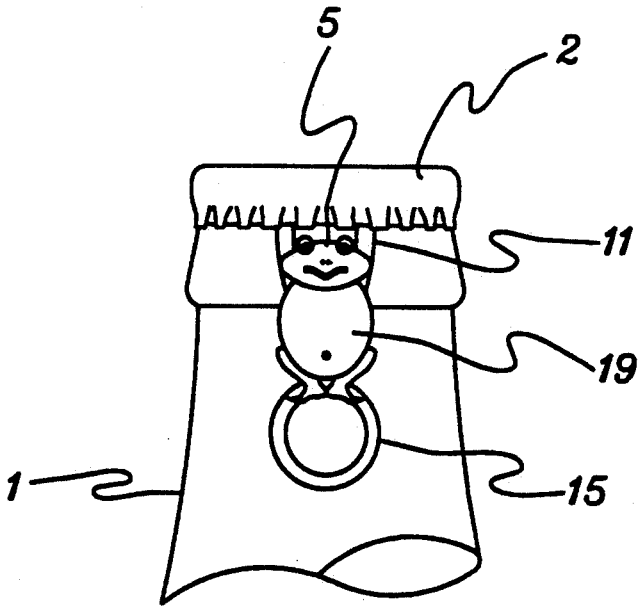
FIG. 8 is a frontal view according to a fourth embodiment of the device of the present invention.

FIG. 8 illustrates a fourth embodiment of the present invention, and, in this embodiment, the body of the opener 4 has the shape of a mascot, so that an aesthetic effect to offer an attraction for purchases may be provided in addition to the function to open the bottle cup.

According to the present invention as described above, the head portion of the body of the opener is provided with a round edge to eliminate a sharp edge so as for no one to be hurt by such a sharp edge. Further, reinforcing portions are added on the body of the opener, so that the body should not be bent during use. Further, the lower end of the body of the opener is divided into two outwardly bent branches, or provided with a pulling ring, so that initially the body of the opener can be more easily pulled out.

What is claimed is:

1. A bottle cap having an opener therefor provided integrally with the cap at a peripheral side thereof characterized by said opener comprising:

a grip body;

two spaced apart arms separated by an aperture extending through said opener, the arms extending from said grip body to attachment points on the peripheral side of the cap; and a head portion at an upper end of the grip body between said spaced apart arms, said head portion having a top edge which is convexly rounded, said arms and head portion being configured such that the grip body is rotatable about said attachment points to bring the head portion into contact with an upper edge of the peripheral side of the bottle cap leaving the rounded edge exposed.

2. The bottle cap having an integral opener as claimed in claim 1, wherein said grip body is shaped like a saddle roof with reinforcing portions at either side of a longitudinal center ridge.

3. The bottle cap having an integral opener as claimed in claim 2, wherein said head portion is connected to the side of said bottle cap.

4. The bottle cap having an integral opener as claimed in claim 2, wherein said head portion is inwardly curled so as to form said rounded edge, said head portion being unconnected to the side of said bottle cap.

5. The bottle cap having an integral opener as set forth in claim 2, further comprising two branches extending from a lower end of said grip body and bent outwardly with respect to said grip body, said branches being divided at said center ridge.

6. The bottle cap having an integral opener as claimed in claim 2, further comprising a pulling ring attached to a lower end of said grip body.

7. The bottle cap having an integral opener as claimed in claim 2, wherein an upper face of said bottle cap is provided with a folding line.

8. The bottle cap having an integral opener as claimed in claim 1, wherein said grip body has a shape of a mascot.

* * * * *